United States Patent [19]

Hehemann

[11] 4,297,535

[45] Oct. 27, 1981

[54] STEREO HEADSET

[76] Inventor: Gunter Hehemann, Kaiser-Wilheim Strasse 3B, D-8130 Starnberg, Fed. Rep. of Germany

[21] Appl. No.: 924,760

[22] Filed: Jul. 14, 1978

[30] Foreign Application Priority Data

| | | | |
|---|---|---|---|
| Jul. 18, 1977 | [DE] | Fed. Rep. of Germany | 2732425 |
| Aug. 1, 1977 | [DE] | Fed. Rep. of Germany | 2734624 |
| Sep. 12, 1977 | [DE] | Fed. Rep. of Germany | 2741049 |
| Sep. 12, 1977 | [DE] | Fed. Rep. of Germany | 2741004 |
| Nov. 3, 1977 | [DE] | Fed. Rep. of Germany | 2749234 |

[51] Int. Cl.[3] ..... H04R 5/00

[52] U.S. Cl. ..... 179/156 R; 179/1 G

[58] Field of Search ..... 174/1 GP, 156 R, 1 GA, 174/1 G, 1 GQ

[56] References Cited

U.S. PATENT DOCUMENTS

| | | | |
|---|---|---|---|
| 2,837,597 | 6/1958 | Lubow | 179/1 GP |
| 2,978,543 | 4/1961 | Kennedy | 179/1 GP |
| 3,891,810 | 6/1975 | Hayashi | 179/156 R |
| 3,939,310 | 2/1976 | Hodges | 179/156 R |
| 4,110,583 | 8/1978 | Lepper | 179/156 R |

FOREIGN PATENT DOCUMENTS

| | | | |
|---|---|---|---|
| 2126677 | 8/1972 | Fed. Rep. of Germany | 179/156 R |
| 2335201 | 2/1975 | Fed. Rep. of Germany | 179/156 R |
| 1042146 | 9/1966 | United Kingdom | 179/156 R |

*Primary Examiner*—Thomas W. Brown

[57] ABSTRACT

A stereophonic headphone having a pair of earpieces, each having associated electro-acoustic main transducers and sound chambers. Each of the sound chambers are coupled acoustically to at least one first sound tube serving to transmit a portion of the sound from the other earpiece to the coupled sound chamber. The sound tube acts to delay the transmission of said sound for a period of time which corresponds to the rectilinear propagation of the sound in a standard deflection section of 15 to 25 cm.

10 Claims, 3 Drawing Figures

STEREO HEADSET

The present invention relates to stereophonic headphones and in particular to headphones having earpieces in enclosed or semi-enclosed construction having an associated sound chamber, and an electro-acoustic sound transducer, the sound chambers being additionally coupled acoustically by one or more sound carrying tubes to enhance the auditory experience.

A major drawback in the reproduction of two-channel stereophonic music through headphones is the inherent production of an unnatural sound. During production of a stereophonic recording, the sound engineer mixes the sound so that when it is produced over two loudspeakers they recombine acoustically to come close to the impression perceived in the concert hall. However, the same recording when reproduced through headphones, results in hearing the two stereo channels completely separately. One hears the music without the environmental effects on sound propagation as they would exist in a reproduction loudspeaker. An especially disturbing factor is the lack of orientation in space. By known stereophonic techniques, a certain fanning out is conveyed also with the use of headphones, but only in width, not in depth. An especially disturbing factor here is that headphone reproduction of stereophonic recordings generally lets the center of the audio event take place to the rear, either outside of or in the head (J. Acustica, vol. 29, 1973, page 255), the rear of the head being a preferred site. P. Laws attributes this effect, the so-called in-head localization of the auditory events to the specific linear distortion of sound signals occurring at the respective ear drums, building on his hypothesis, which maintains that the auditory experiences created upon reproduction through different sound sources appear to be natural when the sound signals occurring at the ear drum are in accord with the phase shifts of the sound propagation occurring in natural sound events (loc. cit. page 257). On the basis of extensive hearing tests, J. Blauert and P. Laws found the significance of the phase relationships of the ear drum signals to be a determining factor for the localization of the auditory events, and proposed taking them into consideration with purely electrical means by providing a corrective electrical network (J. Acustica, vol. 29, 1973, pages 273 to 277).

Based on these findings, numerous solutions have become known which try to resolve the disturbing effect of in-head localization caused by the use of headphones, which is due to the separation of the two ears, by employing electrical accessory equipments. For example, the "crosstalk" between the two ears, as it occurs in the free sonic field, is simulated by an electrical network (J. Acustica, vol. 29, 1973, pages 273 to 277). A similar solution provides for the use of electronic delay members having a delay of 0.5 ms each, as well as sound filters to simulate reverberation (published German patent application No. 20 07.623). Another known proposal (German Pat. No. 1 148 269) provides for electric cross couplings, namely multiple coupling with different delays.

Lastly, peripheral electronic equipment has been developed, for the purpose of assigning to the right and left ears only the signal portion belonging to these ears in accord with natural reality. Here normal two-channel stereo signals are spatially processed by electronic means, taking into consideration transit time differences between the right and left ears, deflections at the head, shading effects, head waves, etc.

What all electronically adapted headphone designs, including the aforementioned accessory equipment normally connected to the amplifier or to the control device, have in common is their high production cost. For example, headphone amplifiers for loudspeaker simulation are offered at prices which are ten times higher than those of normal headphone equipment.

In contradistinction, the present invention seeks to provide a headphone where the unnatural sound reproduction, reflected in particular by an incorrect spatial perception of the sound event (in-head localization), is eliminated or improved without resort to expensive electronic solutions.

Heretofore to obtain these results, only partial solutions were known. These however did not lead to satisfactory practical results. For example:

In a known headphone (German patent Disclosure No. 2 126 677), the stereo channel information is supplemented by bilateral mixed hearing, in that the sound transducers are directed toward the inner pinnae of the ears and that additionally a lateral sound source is provided which consists of a flexible tube connection between the two earpieces radiating into the ear normal to the sound direction of the actual sound source.

Analogously to this, numerous other known solutions (U.S. Pat. Nos. 3,891,810, 3,939,310, German patent applications Nos. 25 04 362, 25 04 540) assume that by an acoustic connection between the two earpieces of the headphone one can improve the pure stereo channel information by a reverberatory effect to such an extent that the acoustic impression conveyed by the headphone comes closer to the reproduction by two stereo loudspeakers.

Actually these known solutions achieve merely a certain dissolution of the body of sound, i.e. the stereo effect tends to be blurred. A noticeable improvement is not achieved in avoiding the in-head localization already described as being disadvantageous.

Lastly a headphone system for stereophonic reproduction is known (German patent Disclosure No. 2 335 201), according to which the forward-backward localization, found to be deficient is to be achieved by creation of an artificial sonic field which comes close to the natural sonic field. In addition to the arrangement of acoustic resistances at the ends of the sound lines leading into the earpiece, an acoustic and/or electic coupling circuit, possibly with means determining the frequency characteristic and/or transit time, may be provided between the two earpieces.

Notwithstanding these attempts, the prior solutions are not totally successful in overcoming all the difficulties mentioned.

According to the present invention, the aforementioned problems are overcome by providing a stereophonic headphone having its sound chambers additionally coupled acoustically by one or more sound tubes, so that into each sound chamber there is lead at least one sound tube (differential sound tube) which is traversed by sound of the other sound chamber in a period of time which corresponds to the rectilinear sound propagation in a deflection section to the range of 15 to 25 cm. Preferably, the deflection is 20 cm in length.

The insufficiencies of the known systems are due to their lack of adaption to the specific facts of human hearing. As the path of sound from a source to each of the ears is practically never equally long, the sound hits each ear at a different time. Because of the deflection of the sound around the head, the sound reaches the ear further away from the source later, by fractions of a millisecond if the source is on one side of the head. From this delayed impingement of the sound, together with a somewhat reduced volume and a different timbre (damping of overtones), the human brain determines the impingement direction of the sound and the approximate distance of the sound source. For example, if the sound source is arranged exactly laterally, the additional path to be travelled due to deflection to the off ear is over 30 cm. Taking a mean value, namely a sound source disposed under 45 degrees of angle laterally of the horizontal median axis of the head, the path difference of the sound will be between 15 and 25 cm. For a deflection section of this length and a sound velocity in air of about 334 m/sec this means a delay of 0.5 to 0.6 milliseconds. Simulation of this delay value as accurately as possible in a headphone system consistutes the decisive finding of the present invention. In addition, the slight differences observable in natural audio events with regard to volume and timbre due to the shading of one ear relative to the other are also taken into account and play a role in providing more natural sound through the headphones.

The defined deflection section is a measure of the desired time delay approaching natural conditions, caused by the deflection of the sound around the bend of the head on its way from the sound source to the respective ear. This deflection effect is simulated in the so-called differential sound tube by which the sound from one earpiece is transmitted to the other earpiece.

The superior effect of this mechanical-acoustic solution can be clearly demonstrated in simple model tests. A sound event which in the known headphone systems is located behind the head or in the back of the head moves, when using the solution according to the invention, to in front of the head, or at least into the fore part of the head—individual differences do not permit an exact determination—with the result that the user of the headphone according to the invention receives a natural acoustic impression without the disturbing in-head localization. This is true also of a location of the auditory event in the anterior or forehead region of the head, which is much pleasanter than when the sound perception is in the back of the head, as with the known headphones.

Additional benefits lie in the major technical-economical advantages of the system of the present invention. As compared with the provision of a differential sound tube according to the invention, the purchase of an electronic reverberation system as an accessory for the headphones results in an approximately hundredfold cost increase. Compared with the electronic solutions, the headphone of the invention is much less trouble-prone. Compared with the known connecting lines between the earpieces of the headphone, whose length does not correspond to the deflection section, there results a much more distinct forward orientation of the sound source.

Another especially advantageous embodiment is to provide, in addition to the two sound transducers, two auxiliary sound transducers which, via auxiliary sound tube or sound tube section whose length corresponds to the deflection section, are connected with one of the sound chambers and are connected in parallel. With this particular proposal, as distinguished from the solution explained above, the sound propagation in a special gas section can be dispensed with; the additional costs for the two auxiliary sound radiators are low by comparison. The use of auxiliary sound transducers offers the possibility that thereby the frequency filtering caused by deflection can be realized in a simple manner, in a range between 200 and 2000 Hz. In fact, it is known that the human ear is unable to locate audio frequencies under 200 Hz as to direction, and that audio frequencies above about 2000 Hz reach the ear lying in the sonic shade of the head much more weakly, if at all, due to its deflection.

According to another embodiment of the invention, each auxiliary sound transducer is acoustically connected with the associated sound chamber through its own auxiliary (differential) sound tube. In the context of the invention, it is understood that the length of the auxiliary tube corresponds approximately to a deflection section of 20 cm, so that in each ear the desired sound delay relative to the respective other ear of about 0.6 milliseconds is registered. According to the audio-learning experience of the human auditory center, this means the location of a sound source under an angle of 45° forward, more or less in a way which comes closest to natural conditions.

A further approximation of the acoustic experience derived from two stereo loudspeakers is obtained by combining the above described features, which take into consideration the deflection of the sound around the head, with features which simulate the existing room conditions, e.g. wall reflection. Here time differences greater by unit multiples are to be realized than are involved in the delay values for simulating the deflection phenomena. While in that instance 0.6 milliseconds is sufficient, the reflected sound should reach both ears with a delay of at least 4 to 5 milliseconds.

Accordingly, the invention proposes that several tubes of different length be provided, at least one (reflection sound tube) being longer by unit multiples than the standard deflection section or respectively being traversed by the sound in a period of time which, compared with the sound propagation in the standard deflection section, is corresponding longer. At variance with the previously explained "short" differential sound tube for the simulation of deflection phenomena, with the "long" sound tubes, henceforth called reflection sound tube, the so-called reverberatory effects are simulated, which, in adaptation to the long paths in wall reflection of the sound, requires much greater delay values.

If there is to be used a sound tube which is too short to provide the desired time delay, such as for example a desired reflection sound tube extending parallel to a headphone strap, whose average length is about 34 cm and hence is traversed by the sound in about one millisecond, a desired further delay can be obtained according to the invention by dividing the sound tube by two membranes into three single chambers.

Instead of sound tube connections between the two earpieces, it may be provided in the context of the invention that the sound tubes of different length leading into a sound chamber (differential and/or reflection sound tubes) are connected to auxiliary sound radiator transducers which are connected in parallel with the sound transducers of the respective other sound chamber. Such an arrangement offers the advantage that the sound signals are controllable by electric means, for example, by balance controls or tone quality controls yet the introduction of the sound from one ear to the other is acoustically accomplished.

Full details of the present invention are set forth in the following description and in the accompanying drawings. In the drawings.

Figure 1:
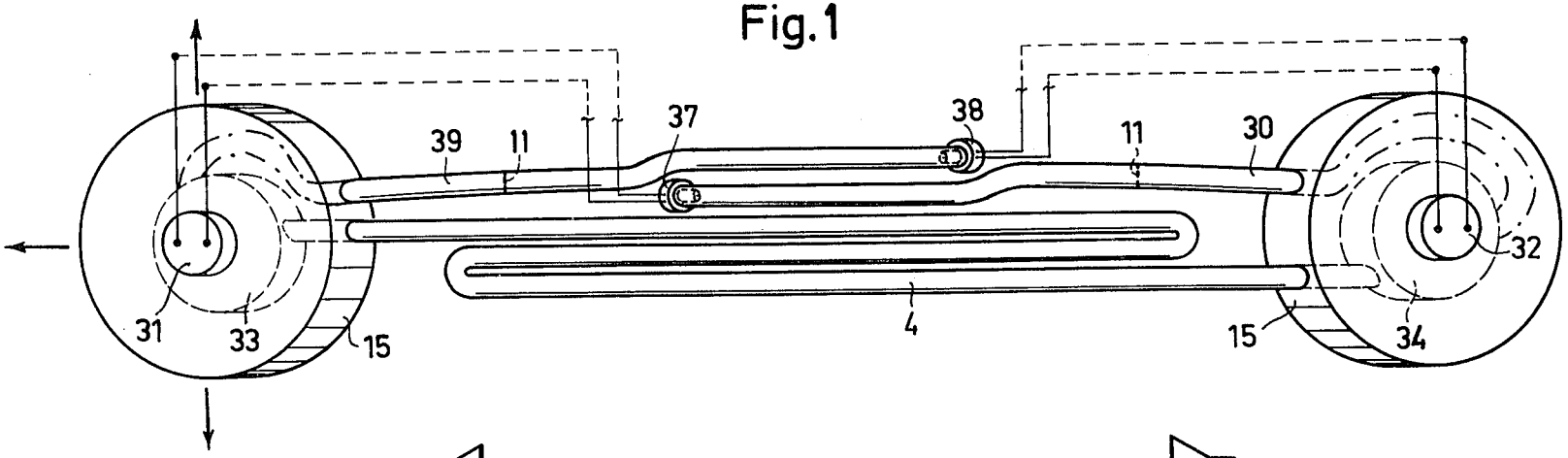
FIG. 1 is a view of a headphone, laid out in flat form to show the differential and reflecting sound tubes interconnecting the opposite earpieces according to the present invention.

For simplicity, clarity and brevity, the individual figures of the accompanying drawings may incorporate more than one inventive feature. The drawings are therefore to be taken as illustrative of the various features of the inventions and not necessarily depicting In FIG. 1 the left earpiece defined by the padding 15, is provided with a sound transducer 31 associated with a sound chamber 33. The right earpiece, defined by the padding 15 is provided with a sound transducer 32 associated with a sound chamber 34. The headphone is provided with a left auxiliary sound transducer 37 which via a right auxiliary sound tube 30 transmits the reverberation of the opposite sound chamber 33. A right auxiliary (transducer) 38 transmits reverberation to the opposite sound chamber 33 via the left auxiliary sound tube 39. Additional filtering of the undesired high and low audio frequencies is obtained by placing a passive membrane 11 for example, a thermal plastic foil within each of the two auxiliary sound tubes 30 and 39 as previously described. A coil or folded reflection sound tube 4 also connects the sound chambers 33 and 34.

The differential sound tubes 30, 39, are of a length suitable to create a sound delay corresponding to a standard deflection section of 15 to 25 cm. The range of 15–25 provides a time delay of approximately 0.4 to 0.8 milliseconds and alone will provide the advantage enumerated earlier. The optional length being 20 cm. induces a delay of 0.6 milliseconds. Additionally, an elongated reflection sound tube 4 may be employed. The reflection sound tube is arranged in a serpentine manner, between both of the earpieces 1 and is of a sufficient length to provide a time delay of 4 to 5 milliseconds.

Figure 2:
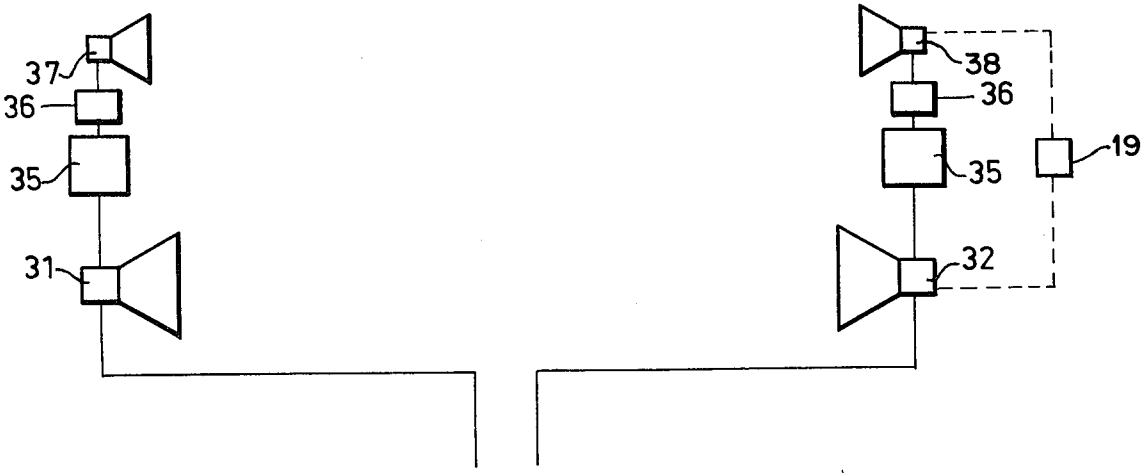
FIG. 2 is a block diagram showing the transducer circuit arrangement of the headphone of FIG. 1.
Figure 3:
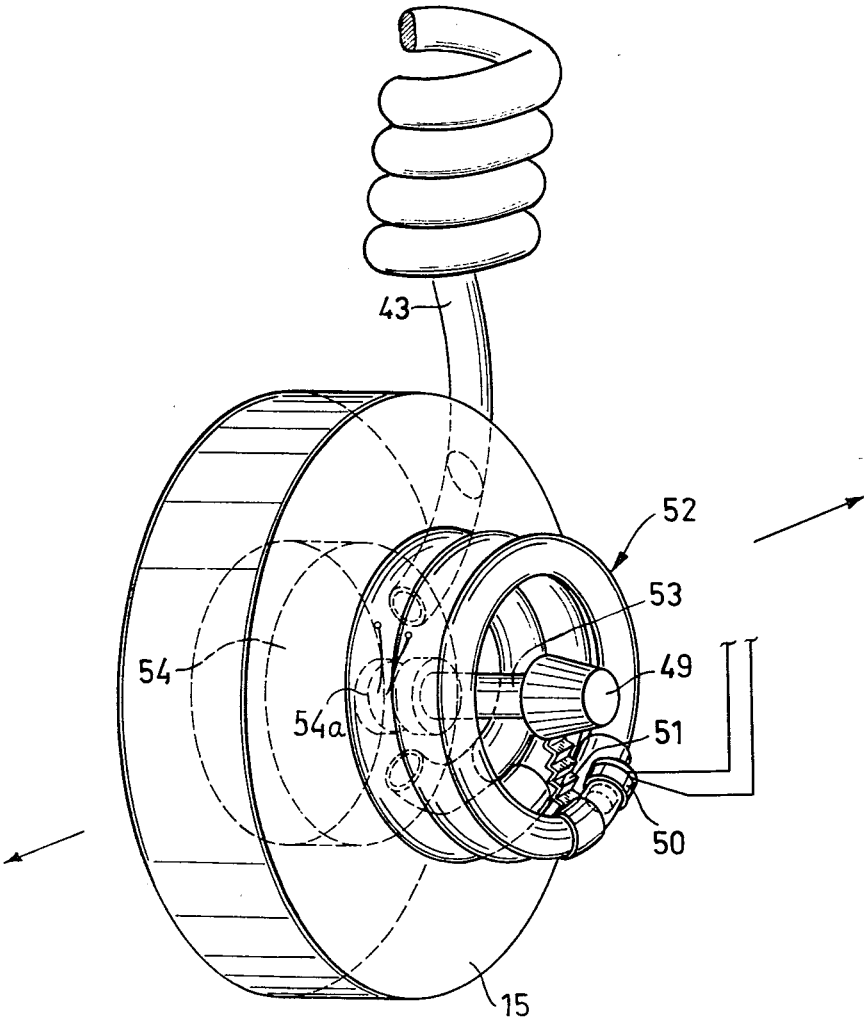
FIG. 3 is an enlarged perspective from behind view of a right earpiece of a headphone showing modified forms of the sound tubes.

The block diagram of FIG. 2 illustrates the parallel connection of the sound transducers 31 and 32 to the respective auxiliary sound radiators 37 and 38. Potentiometers 35 and/or tone controls 36 are inserted prior to the two auxiliary sound radiators 37 and 38 for their individual control. The relative intensity volume of the cross reverberation as well as the timbre of the sound conducted to the respective opposite earpieces can thereby be regulated. Additionally, a balance control 19, shown in broken lines may be provided for the mutual matching of the sound transmitters 31 and 32 with the auxiliary sound radiators 37 and 38. A still further embodiment of the present invention is shown in FIG. 3. Here the earpiece has an annular padding 15 defining the sound chamber 54 (having a main transducer 54A) into which the outlet end of a reflection sound tube 43 extends. The outlet end is secured to the padding 15, and the reflection sound tube is coiled to increase its length over a short linear distance. A helically coiled auxiliary differential sound tube is mounted on the exterior of the annular pad 15 concentrically with the central axis of the sound chamber and is provided with an auxiliary sound transducer 50 at its end, electrically connected as indicated previously. The auxiliary differential sound tube is composed of three curved sections, one section telescoping within the other. The free end of the inner section extends radially into the sound chamber 54 while the free end of the outer section is connected by a bracket element 51 to a rotatable axle 53 mounted along the central axis of the earpiece. The connecting bracket element 51 is made of a plastic or metal material in the form of an elongated band which is folded or corrugated so as to be variable in length but stable in the circumferential direction of the spiral formed by the differential sound tube. Mounted at the outer end of the axle 53 is a knurled knob 49. Manipulation of the knob 49 rotates the axle 53 which in turn causes the bracket 51 to move the sections of the differential sound tube rotatably about the axis 53 elongating or reducing the spiral size of the auxiliary sound tube 52. This elongation and/or reduction of the size of the spiral regulates the period of reverberation delay. It is thus possible to make the angle at which the sound source occurs, appear to be in front of the headphone user and variable for the purpose of individual adaption to divergent audio learning experiences and to individual auditory tests.

From the foregoing, it will be observed that the various advantages and objectives of the present invention enumerated earlier have been fulfilled. The conversion of a headphone, which would normally provide two distinct channels of sound, into a more natural stereophonic sound producer is provided in each of the embodiments by the use of a mechanical acoustic connection between the respective sound chambers comprising a differential sound tube having a length sufficient to delay the transmission of the sound for a period of time corresponding to the rectilinear propagation of the sound in a standard deflection section of 15 to 25 cm. It has been found that it is preferable to have the standard deflection section of 20 cm in length. This produces a time delay of approximately 0.6 milliseconds. In the event, however, that due to physical size of the headphone, the length of the differential tube is greater or smaller than that which would produce the desired result, the present invention further shows the construction of the differential tube wherein a section is defined by sound permeable membranes, in which a media other than air is contained. The media is chosen to either increase the velocity of the sound, or to decrease its velocity and thereby providing simple means for regulating the transmission of the cross sound.

In supplement of the differential sound tube, the present invention provides for an additional reflection sound tube connection between opposing earpieces. The reflection sound tube is of a length longer by a multiple of the standard deflection to provide a time period preferably between at least 4 and 5 milliseconds, thus providing enhanced sound reproduction simulating ambient environmental conditions. The length of the reflection tube is therefore required to be considerably longer than that of the differential tube and can be made in the form of folds and/or spirals or serpentine construction as is clearly shown. Alternatively, the use of gaseous sections may also be made to regulate the sound velocity.

Still, in addition, the cross transmission of sound between opposing chambers may be made via the introduction of auxiliary transducer and/or radiators, taking their signal from one earpiece, and transmitting the sound via sound tubes directed into the sound chamber of the other earpiece. Preferably, the auxiliary transducers are electronically rated so that they radiate predominantly an exclusive audio frequency with range of between 200 Hz to 2000 Hz. It has also been found that inner diameters of the sound tubes should not exceed 5 mm.

To enhance the illusion of the sound coming from the front, the outlets of all differential sound tubes, as well the outlets of the tubes including a gas section speeding the sound as well as the auxiliary sound tubes, should come in from the front part of the sound chamber. To counteract the tendency of the sound coming from above it may even be advisable to let the above mentioned outlets come in from below.

Various other modifications, changes and embodiments have been shown. Additional embodiment and variations will be obvious to those skilled in the present art. It is therefore intended that the present disclosure be taken as illustrative only of the present invention and not limiting.

What is claimed is:

1. A stereophonic headphone comprising a pair of earpieces, each having an electro-acoustic main transducer and a sound chamber, a first sound tube coupling each of said sound chambers and a pair of auxiliary electro-acoustic sound transducers each connected electrically in parallel to the main transducer of an associated one of said earpieces, the sound chambers of each earpiece being respectively coupled acoustically to the auxiliary transducer connected to the main transducer of the other earpiece by one of a pair of second sound tubes acting to delay the transmission of said sound for a period of time which corresponds to the rectilinear propagation of the sound in a deflection section of 15 to 25 cm.

2. The headphone according to claim 1, wherein the deflection section is 20 cm. in length.

3. A stereophonic headphone comprising a pair of earpieces, each having an associated electro-acoustic main transducer and sound chamber, each of the sound chambers being coupled to one of a pair of first sound tubes serving respectively to transmit a portion of the sound from the other earpiece to the coupled sound chamber and acting to delay the transmission of said sound portion for a period of time which corresponds to the rectilinear propagation of the sound in a deflection section of 15 to 25 cm. and a second sound tube serving to transmit a portion of the sound from one chamber to the other in a period of time greater than a multiple of the deflection section.

4. The headphone according to claim 3 wherein at least one of the first mentioned sound tubes is connected to an auxiliary sound transducer, which is connected in parallel with the main sound transducer of the other sound chamber.

5. The headphone according to claim 1 or 3, wherein each of the first sound tubes is formed of telescoping sections and is variable in length.

6. The headphone according to claim 1 or 3, wherein each of the first sound tubes is helical and is disposed substantially about the central axis of the associated earpiece, said headphone including a rotary shaft, and a connecting element securing one end of said helical sound tube to said shaft, said connecting element having a knob such that the length of said sound tube is variable by turning the knob.

7. The headphone according to claim 1 or 3, wherein at least one of said sound tubes is provided with a membrane for filtering out high frequencies.

8. The headphone according to claim 1 or 3, wherein the inside diameter of each of said sound tubes is at most 5 mm.

9. In a stereophonic headphone having two earpieces, each having a sound chamber, the method of providing natural sound comprising the steps of producing a sound by a main transducer associated with each earpiece, coupling together the sound chamber of said earpiece with a first acoustic tube, connecting the main transducer of each earpiece electrically in parallel with an auxiliary transducer, and transmitting a portion of the sound from one earpiece to the sound chamber of the respective opposite earpiece via the auxiliary transducer by one of a pair of second acoustic tubes with a delay in transmission of said sound corresponding to the rectilinear propagation of the sound in a deflection section of between 15 to 25 cm.

10. A stereophonic headphone comprising a pair of earpieces, each having an associated electro-acoustic main transducer and sound chamber, each of the sound chambers being coupled acoustically to one of a pair of first sound tubes serving to transmit a portion of the sound from the other earpiece to the coupled sound chamber and acting to delay the transmission of said sound portion for a period of time which corresponds to the rectilinear propagation of the sound in a deflection section of 15 to 25 cm., incuding a pair of auxiliary electro-acoustic sound transducers, each connected in parallel to a respective one of said main transducers and being acoustically coupled to the sound chamber of the other one of said main transducers, by an associated one of said first sound tubes and a second sound tube serving to transmit a portion of the sound from one sound chamber to the other in a period of time corresponding to a length greater than a multiple of the deflection section.

* * * * *